US006243021B1

(12) United States Patent
Leontiev et al.

(10) Patent No.: US 6,243,021 B1
(45) Date of Patent: Jun. 5, 2001

(54) INDICATING AND MEASURING INSTRUMENT

(75) Inventors: Daniel Leontiev, Cerritos; Stefan Serban Nastase, Fontana; J. Steven Hollander, Los Angeles, all of CA (US)

(73) Assignee: Newport Electronics, Inc., Santa Ana, CA (US)

( * ) Notice: Subject to any disclaimer, the term of this patent is extended or adjusted under 35 U.S.C. 154(b) by 0 days.

(21) Appl. No.: 09/428,543

(22) Filed: Oct. 28, 1999

Related U.S. Application Data

(60) Provisional application No. 60/106,874, filed on Nov. 2, 1998.

(51) Int. Cl.[7] ..... G08B 5/22

(52) U.S. Cl. ..... 340/815.45; 340/815.53; 340/815.56; 340/815.65; 345/117

(58) Field of Search ..... 340/815.45, 815.53, 340/815.43, 815.44, 815.49, 815.56, 815.65; 313/116, 498; 345/117

(56) References Cited

U.S. PATENT DOCUMENTS 4,705,406 * 11/1987 Havel ..... 368/10
4,707,171 * 11/1987 Havel ..... 368/11
4,845,745 * 7/1989 Havel ..... 379/354
4,929,936 * 5/1990 Friedman et al. ..... 345/117

* cited by examiner

*Primary Examiner*—Davetta W. Goins
(74) *Attorney, Agent, or Firm*—William A. Drucker

(57) ABSTRACT

An electronic instrument has a display with a group of light emitting diode elements, the elements of a first portion of the group being of a first color when energized, and the elements of a second portion being of a second color when energized. The elements of the first portion are juxtaposed to the elements of the second portion, so that when both elements are energized at the same time, they collectively display a third color which is a derivative of their respective colors.

6 Claims, 3 Drawing Sheets

INDICATING AND MEASURING INSTRUMENT

This application claims priority under 35 U.S.C. 199(e)(1) based upon previously filed application Ser. No. 60/106,874 filed Nov. 2, 1998.

FIELD OF THE INVENTION

This invention relates to the field of electronic instruments for indicating and measuring variable parameters such as temperature, viscosity, and density, and for indicating states such as achievement of or regression from a limit of a variable parameter.

OBJECTS OF THE INVENTION

A first object of the invention is to provide an improved electronic instrument having pairs of light emitting diode elements which, when energised, are of two respective colours and which are so arranged relative to each other that when energised simultaneously they display a third colour which is a derivative of their respective colours.

A second object of the invention is to provide an arrangement, of pairs of light emitting diode elements, which permits display, when the elements are energised, of almost all of the letters of the alphabet and also the numerals from "0" to "9" with a clarity hitherto obtainable only with a greater number of diode elements.

SUMMARY OF THE INVENTION

According to the invention there is provided an electronic instrument having a display comprising a group of light emitting diode elements, the diode elements of a first portion of the group being of a first colour when energised, the diode elements of a second portion of the group being of a second colour when energised, the respective individual diode elements of the first portion of the group being each juxtaposed to a respective individual diode element of the second portion of the group such that when both of the juxtaposed diode elements are energised at the same time they collectively display a third colour which is a derivative of their respective colours.

DETAILED DESCRIPTION OF THE DRAWINGS

Figure 1:
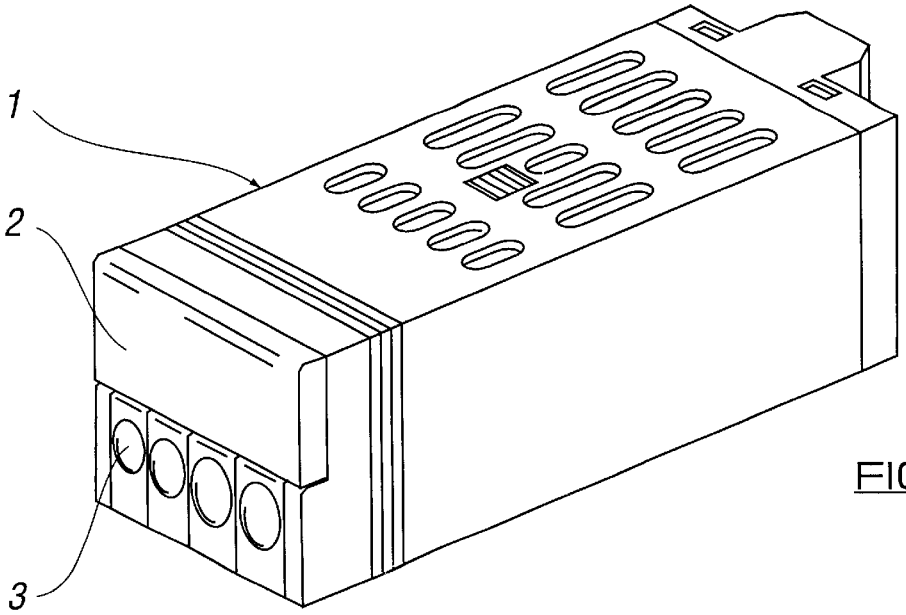
FIG. 1 is a perspective elevation, from the front and one side, of an electronic instrument, such as a meter or controller.
Figure 2:
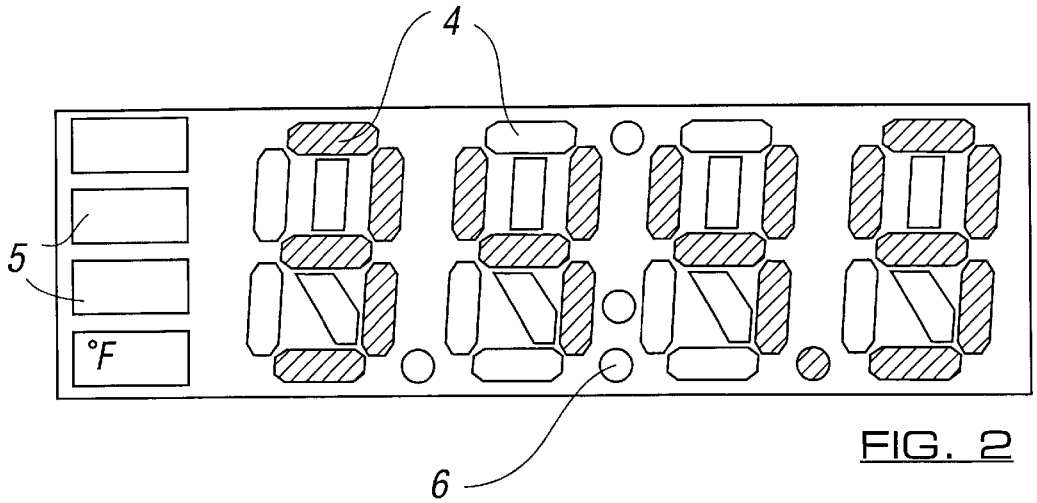
FIG. 2 is a front elevation of a screen of the instrument to show an example of indication of temperature.
Figure 3:
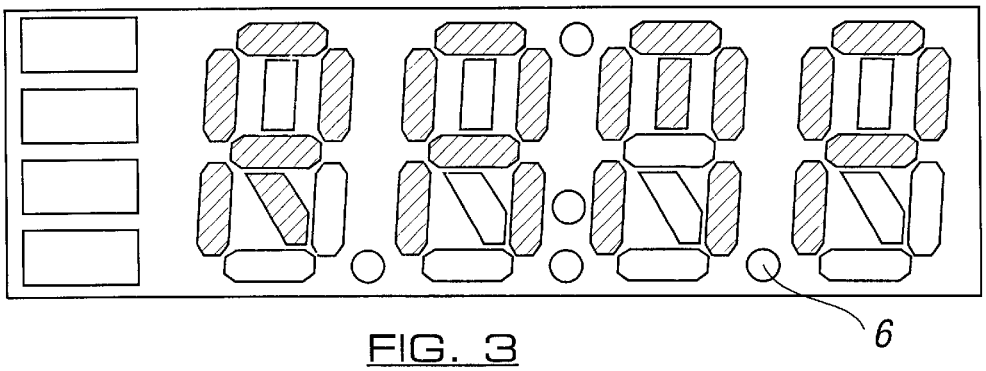
FIG. 3 is a front elevation of the screen of the instrument to show an example of indication of a function.

Referring now to FIG. 1 of the drawings, there is shown an electronic instrument 1, such as a meter for indicating a number of parameters, or a controller for controlling for example steps in a process or operation. At the front end of the instrument there is a screen structure 2, and a plurality of controls 3, such as push button switches. Referring to FIGS. 2 and 3 of the drawings, the screen structure 2 has four groups of light emitting diode elements 4, and four indicator panels 5 to serve, for example, to show the nature of a parameter which is being indicated or controlled.

In FIG. 2, the screen 2 with its light emitting diode elements 4, is indicating a temperature of 344.9 degrees Fahrenheit.

In FIG. 3, the screen 2 with its light emitting diode elements 4, is indicating a function "RAMP".

Figure 4:
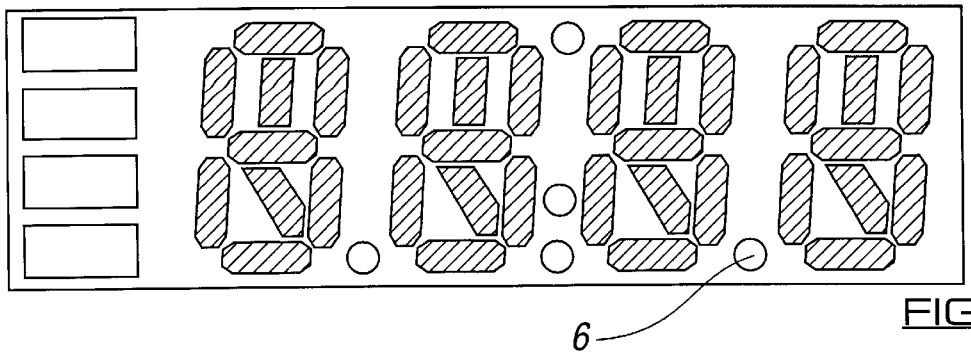
FIG. 4 is a front elevation of the screen of the instrument to represent the appearance of the groups of light emitting diode elements when the colour is red.
Figure 5:
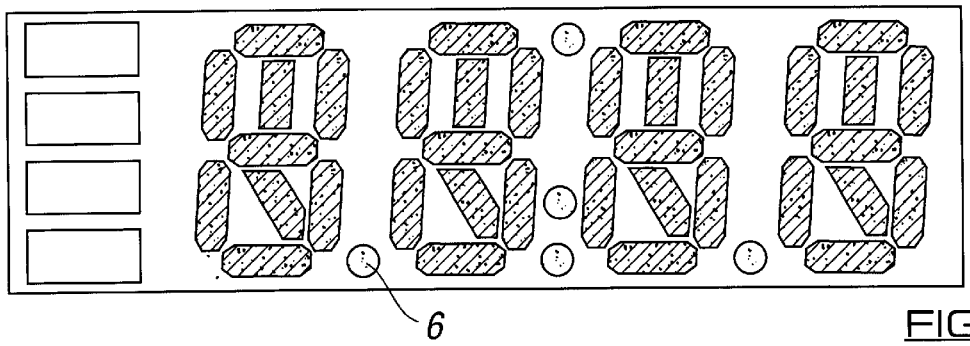
FIG. 5 is a front elevation of the screen of the instrument to represent the appearance of the groups of light emitting diode elements when the colour is amber.
Figure 6:
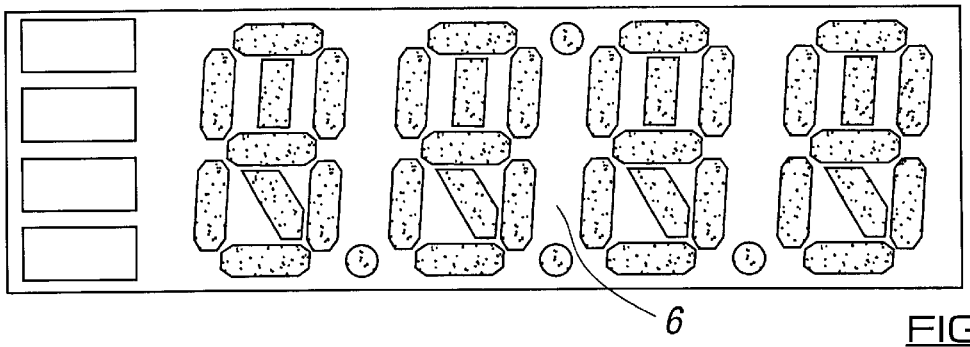
FIG. 6 is a front elevation of the screen of the instrument to represent the appearance of the groups of light emitting diode

Referring to FIGS. 4,5 and 6 of the drawings, FIG. 4 is intended to indicate, by the shading of the light emitting diode elements, that they are showing as red in colour. In FIG. 6 the shading is intended to indicate that they are showing green in colour. In FIG. 5, the colours red and green are combined to show the colour amber.

In FIGS. 2,3,4,5 and 6 the light emitting diode elements 6 are provided at a number of positions to permit the showing of, for example, decimal points, full-stops, and colons.

Figure 7:
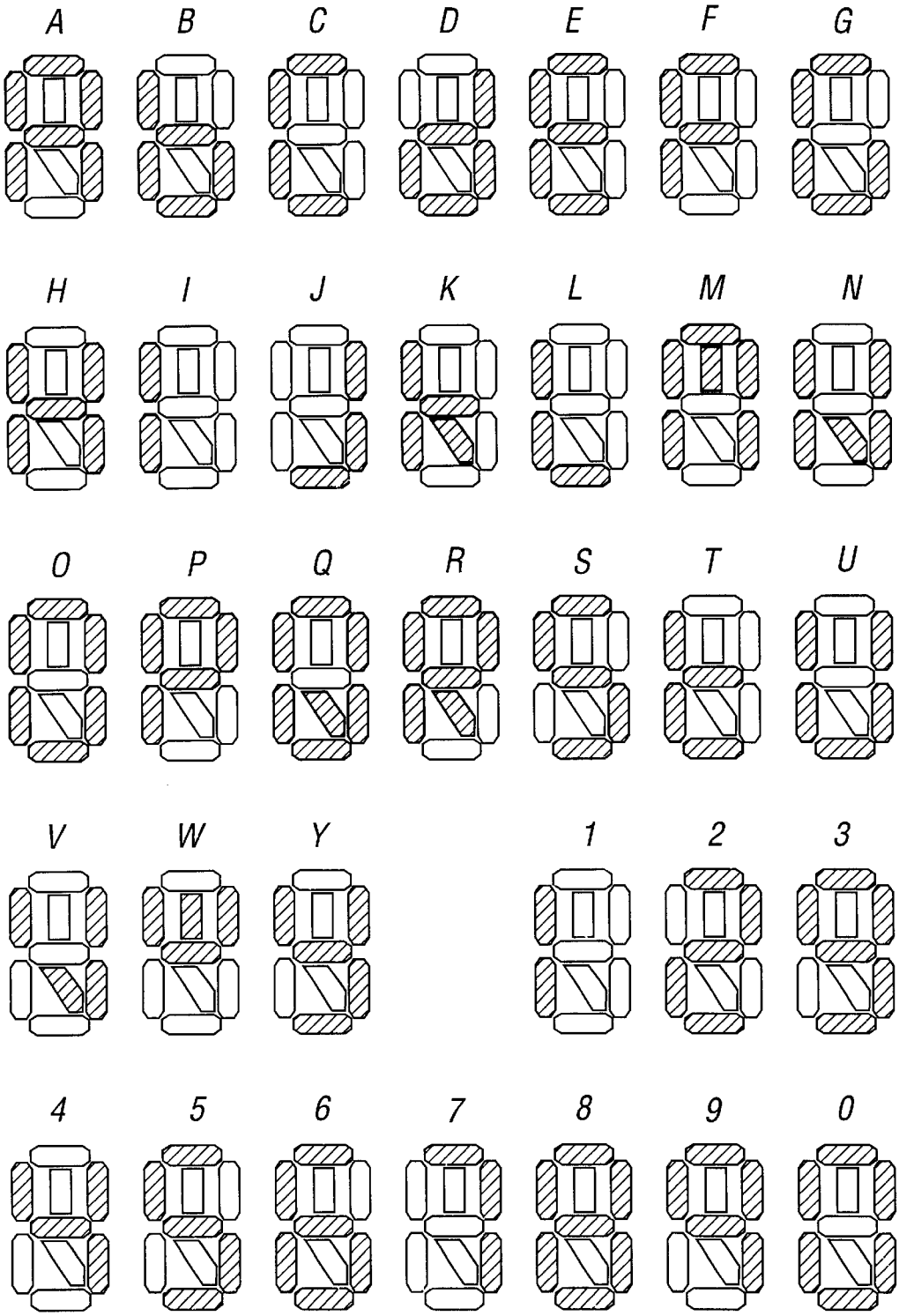
FIG. 7 shows the manner in which nine elements of a group of light emitting diode elements can be used to form all of the letters of the alphabet with the exception of the letters "X" and "Z", and to form all of the numbers from "0" to "9"

Referring to FIG. 7 of the drawings, there are shown illustrations of the manner in which nine individual light emitting diode elements can be selectively illuminated to indicate all of the letters of the alphabet with the exception of the letters "X" and "Z", and all of the numbers for "0" to "9".

The use of four groups of light emitting diode elements 4 is by way of example only, and any desired number of such groups could be provided on a screen structure 2, and arranged in any other desired formation, such as stacked vertically or disposed in a circle or other figure.

As described above, the light emitting diode elements are selected with the two colours red and green, so as to combine, when desired, to form a third colour, amber.

The electronic circuitry required to power and to switch light emitting diode elements is well known in the electronics art, and need not be described herein.

The feature provided by the present invention is that there is a choice, within the same screen structure, to show each of three colours, and to change the manner in which they occur. By way of example, if the electronic instrument is a temperature indicator, the screen 5 may have its light emitting diode elements all coloured green so long as the temperature being measured or indicated is within a certain limit. The arrangement can then be such that if the temperature being measured or indicated passes above a desired norm, the colour of the light emitting diode elements changes to amber. Again, if the temperature being measured or indicated goes still higher and exceeds a predetermined safety level, the colour of the light emitting diode elements then changes to red. The changes in colour may be quickly seen from a distance, so that for example an operator in charge of a machine or a process can quickly react to the changing conditions. Similarly, if the temperature subsequently goes below the safety limit, the colour can change back again to amber, and with still further reduction of the temperature, can change back to green.

The electronic instrument can also be programmed to display, permanently, only a selected one of the three colours, so that where a plurality of instruments are used, say three in number, one may display permanent red, another permanent amber, and a third permanent green, for example to indicate three parameters such as temperature, pressure, and flow.

In another embodiment, the instrument is programmed so that when a selected colour is achieved, that colour is "latched on" until an appropriate change in the indicated parameter is provided by an operator or by other control circuitry.

The number of elements in each of the light emitting diode groups is nine, as distinct from the seven or fourteen elements known hitherto, and permits provision of almost all of the letter of the alphabet and any desired numerical indication, at a greater brightness and clarity, or smaller size, than was available hitherto.

The use of nine diode elements provides a letter display that is easier for the user to understand than a display which is obtained with only seven diode elements. As compared with a fourteen diode element display, the nine diode element display of this invention can be smaller and is less costly. A further advantage of the nine diode element display of this invention is that the letters or numbers of the display can be made of a lesser height, for example 10 mm., and the use of a lesser number of diode elements permits the width of the individual diode elements to be greater, in a given display length.

In other embodiments the light emitting diode elements are grouped, additionally to or in substitution of the alphabet and any numerals, so as to provide other indicator signs such as plus and minus sings, shapes used in the chemical and physics arts, and letters of exotic alphabets.

In the drawings, the light emitting diode groups are shown as forming part of a linear instrument face, and in a further embodiment the elements are provided in a circular formation to resemble, for example, a clockface or a circular meter face. In further embodiments both digital-type and analog-type indicators are provided.

In a further embodiment of the invention there are utilised three or more individual colours of light emitting diode elements, to permit the obtaining of further distinct colours and/or of shades of any given colour.

In a further embodiment, use is made of three light emitting diode elements in combination which permits the obtaining of 256 colours. A greater number still of light emitting diode elements provides the possibility of obtaining a "full colour" display.

In a further embodiment of the invention, the strength of illumination of one or more of the light emitting diode elements is made variable, to permit obtaining of degrees of brightness and/or variation of the combined colour obtained.

The invention, in a still further embodiment provides the use of the light emitting diode elements in a pattern or design, as distinct from alpha-numeric indications.

The invention permits the construction of meters, controllers, indicators, and other viewing screens of smaller size than was possible hitherto, by reason of the use of a nine-element formation which gives a 24 letter alphabet. A meter with a 14 diode element display is much larger and costs much more than a 9 element display. A 7 element device does not permit of obtaining anywhere near to a full alphabet. The device of the present invention is of advantage for vehicle dash-board use, cockpit use in aviation, and like environments of small space availability whilst providing clear vision.

In a further embodiment, a plurality of light emitting diode elements are set in line vertically one above another to simulate the conventional mercury or spirit thermometer tube, with for example the lower portion being made to show green, a higher central portion being made to show amber, and an uppermost portion being made to show red, the whole being for use as a temperature indicator.

Figure 8:
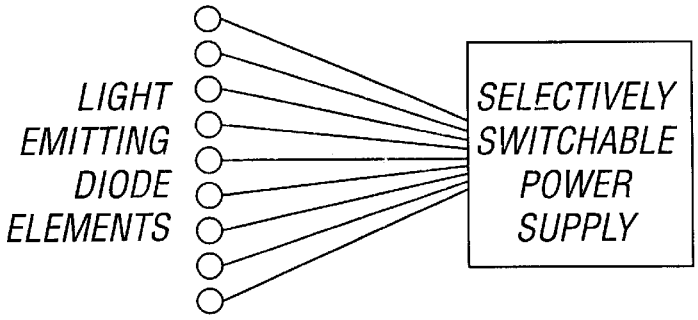
FIG. 8 is a block diagram to show a selectively switchable power supply for the elements of a group of light emitting diodes.

Referring to FIG. 8 there is shown a block diagram to illustrate the selective supplying of power to elements of a group of light emitting diodes.

The diode elements of each group are in "die form" side by side within a reflective housing.

We claim:

1. An electronic instrument having a display comprising a group of light emitting diode elements, the diode elements of a first portion of the group being of a first colour when energised, the diode elements of an equal second portion of the group being of a second colour when energised, the respective individual diode elements of the first portion of the group being each juxtaposed to a respective individual diode element of the second portion of the group such that when both of the juxtaposed elements are simultaneously energised they collectively display a third colour which is a derivative of their respective colours.

2. An electronic instrument, as claimed in claim 1, wherein the group of light emitting diode elements are disposed to indicate an alpha-numeric symbol.

3. In combination, in an electronic instrument as claimed in claim 1, a group of light emitting diode elements, means for selectively energising the diode elements of the first portion of the group, means for selectively energising the diode elements of the second portion of the group, and means for selectively energising simultaneously and separately the diode elements of the first and of the second portions of the group.

4. An electronic instrument, as claimed in claim 1, wherein the diode elements of the first portion of the group are selected to be coloured red when energised, and the diode elements of the second portion of the group are selected to be coloured green when energised, such that when the elements of both groups are energised simultaneously their combined colour is amber.

5. An electronic instrument, as claimed in claim 1, wherein each group consists of nine diode elements.

6. The method of operating an electronic instrument having a group of light emitting diode elements, the diode elements of a first portion of the group being of a first colour when energised, the diode elements of a second portion of the group being of a second colour when energised, the respective individual diode elements of the two groups being juxtaposed, said method comprising steps of energising the diode elements of the first group to cause the juxtaposed elements to display a first colour, energising the diode elements of the second group to cause the juxtaposed elements to display a second colour, and energising simultaneously the elements of the first and second groups to cause the juxtaposed elements to display a third colour which is a derivative of the first and second colours.

* * * * *